United States Patent [19]

Suga

[11] 4,069,416

[45] * Jan. 17, 1978

[54] LAMP EQUIPPED WITH MAGNETS

[76] Inventor: Shigeru Suga, Yoyogi 5-20-2, Shibuya, Tokyo, Japan

[ * ] Notice: The portion of the term of this patent subsequent to Nov. 9, 1993, has been disclaimed.

[21] Appl. No.: 671,699

[22] Filed: Mar. 29, 1976

[51] Int. Cl.[2] ..... F21V 13/00

[52] U.S. Cl. ..... 313/161

[58] Field of Search ..... 240/1 R, 92; 313/161, 313/156, 153, 154, 227, 229

[56] References Cited

U.S. PATENT DOCUMENTS 3,991,336 11/1976 Suga ..... 313/161 X

*Primary Examiner*—Richard A. Wintercorn

*Attorney, Agent, or Firm*—Wenderoth, Lind & Ponack

[57] ABSTRACT

An electrically energized illuminating lamp having a bulb and a source of light within the bulb and emitting light through a portion of the bulb, and at least one magnet around the exterior wall of the bulb at a position other than the portion of the bulb through which light is emitted for attracting metal vapor and volatile matter generated inside the bulb during operation of the lamp and depositing them onto the interior wall of the bulb at a position corresponding to that of the magnet. Deposits are thus prevented on the interior wall of the bulb in light transmission areas thereof to reduce emission of light from the lamp. The lamp can be a mercury lamp or a filament type lamp such as an incandescent or halogen type lamp.

7 Claims, 7 Drawing Figures

LAMP EQUIPPED WITH MAGNETS

This invention relates to a lamp having magnets as a part thereof for concentrating deposits at points on the inside of the lamp enclosure where they will not obstruct emitted light. More particularly, the present invention relates to lamps of the discharge type, such as mercury lamps, or the filament type, such as an incandescent lamp or a halogen lamp, which lamps are equipped with at least one magnet for the above-described purpose.

BACKGROUND OF THE INVENTION AND PRIOR ART

In a conventional illuminating lamp, electrical discharge within the transparent bulb causes heating of the electrodes or tungsten filaments, whereby the metals of which the electrodes or filaments are formed are evaporated, and the evaporated metal is deposited on the entire interior wall surface of the bulb and causes a darkening of the bulb, i.e. a reduction in the amount of light transmitted through the bulb. If the electrodes or filaments contain volatile matter which is emitted during the time of operation of the lamp within the bulb, this results in contamination or turbidity of the lamp.

In either case, the quantity of light transmitted from the light source through the bulb is reduced by about 10% at the end of 1000 hours of lighting operation. In consequence, this type of lamp is not suitable for use as a light source for various optical measuring apparatuses such as light fastness or weathering test apparatuses that require a stable source of a constant quantity of light.

OBJECT AND BRIEF SUMMARY OF THE INVENTION

It is an object of the present invention to provide an illuminating lamp which overcomes the above-described problems in conventional illuminating lamps.

In the lamp according to the present invention, at least one magnet is provided in contact with the exterior wall of the bulb at a position where the magnet does not obstruct the light from the light source, such as, for example, the upper or lower portion of electrodes, or below the filament, and the like, The magnetic field of the magnet attracts metal vapor and other volatile matter from the electrodes or tungsten filament and they are deposited onto the interior wall of the bulb at a position corresponding to the position of the magnet. Thus these undesirable materials are prevented from adhering to an area of the interior wall of the bulb through which light is transmitted.

Because of the above-described arrangement, coloring or formation of turbidity on the portion of the interior wall of the bulb used to transmit light can effectively be prevented and the lamp can maintain its rated quantity of emitted light for a prolonged period of time of usage without a lowering of the quantity of emitted light.

BRIEF DESCRIPTION OF THE DRAWINGS

Other and further features of the present invention will be understood more readily from the following description of a preferred embodiment, taken in connection with the accompanying drawings, in which.

DETAILED DESCRIPTION OF THE INVENTION

Figure 1:
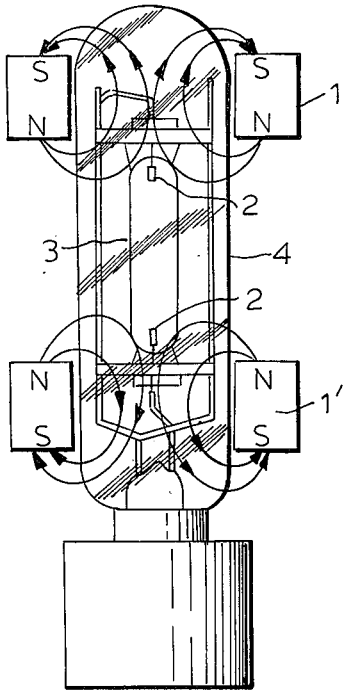
FIG. 1 is a longitudinal sectional view of a mercury lamp equipped with magnets in accordance with the present invention.
Figure 3:
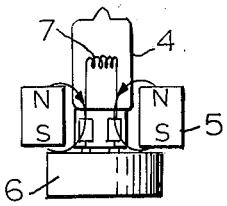
FIG. 3 is a longitudinal sectional view of a halogen lamp equipped with a magnet.

FIG. 1 illustrates an embodiment of the present invention wherein magnets 1 and 1' having an annular shape are fitted around the external bulb 4 of a mercury lamp. The reference numerals 2 and 2' designate electrodes between which extends an internal tube 3 which is the light source of the lamp. As shown, the magnets 1 and 1' are positioned around the external bulb 4 at positions above the electrode 2 and below the electrode 2', respectively, so that they do not obstruct the light being transmitted from internal tube 3 through the unobstructed area of the external bulb 4.

Since the magnetic field of the magnets act in the directions indicated by the arrows, metal vapor and volatile matters inside the internal tube are collected on the interior wall of the internal tube 3 at positions closest to the positions of the magnets. Hence, blackness or turbidity is formed only on these portions, but not on the remaining important light transmitting sections. Accordingly, the lamp can emit a predetermined quantity of light for an extended period of usage.

FIGS. 3 and 4 and FIGS. 5 and 6 illustrate, respectively, a halogen lamp and an incandescent lamp equipped with a magnet in accordance with the present invention. In both lamps, the light source is a tungsten filament 7, and a magnet 5 is positioned around the external bulb 4 around the base thereof where it is fitted to a socket 6.

In either case, the annular magnet 5 is positioned around the external bulb 4 at a position below that of the filament. Accordingly, since the magnetic field acts in the direction indicated by the arrows, the metal vapor and volatile matter produced by the heat of the tungsten filament are collected and deposited onto the interior wall of the bulb 4 at a position below that of the filament, but not on the section of the bulb which transmits light from the filament, For this reason, the lamp can emit a predetermined quantity of light for an extended period of time.

Figure 4:
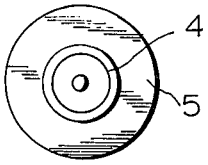
FIG. 4 is a plan view of the halogen lamp shown in FIG. 3.
Figure 2:
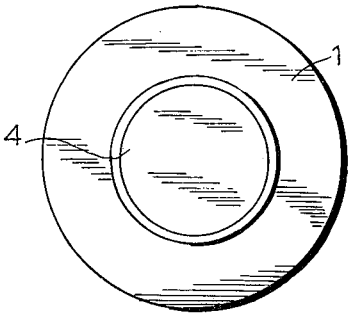
FIG. 2 is a top plan view of the mercury lamp shown in FIG. 1.
Figure 5:
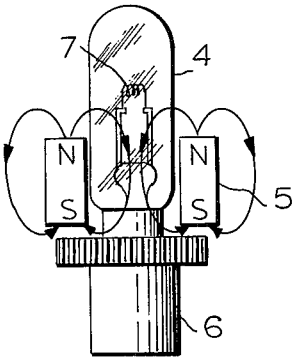
FIG. 5 is a longitudinal sectional view of an incandescent lamp equipped with a magnet.
Figure 6:
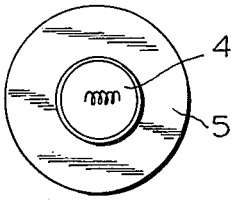
FIG. 6 is a sectional view of the incandescent lamp shown in FIG. 5.
Figure 7:
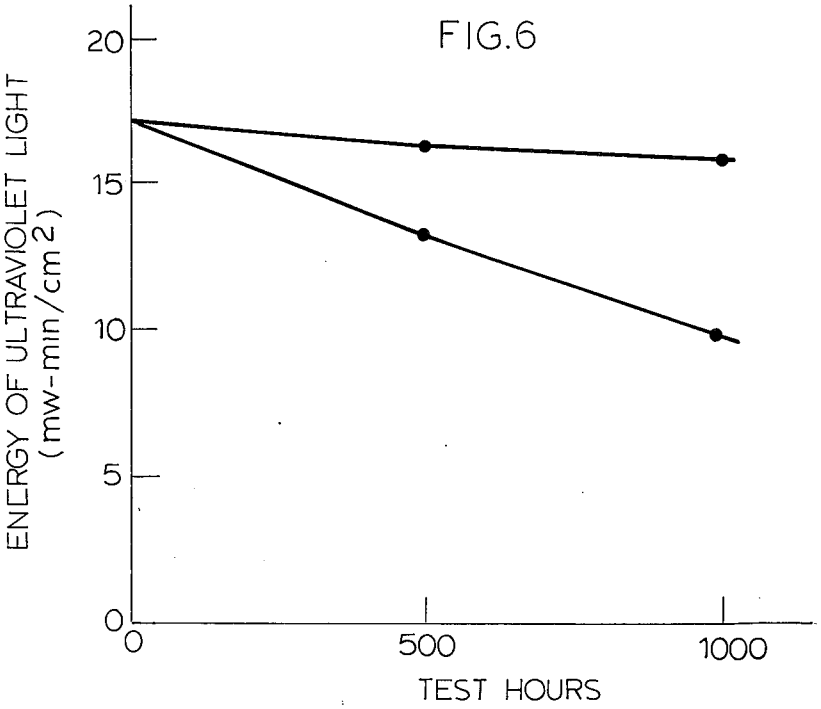
FIG. 7 is a graph illustrating a comparison of the light output of a lamp according to the present invention and a conventional lamp.

As has hereinabove been noted, the lamp in accordance with the present invention hardly changes the quantity of light emitted (i.e. the energy of the emitted ultraviolet rays), even when used for a long period of time. A lighting test conducted with the lamp and comparing it to a conventional lamp of the same type showed, as seen in FIG. 4, that the quantity of light from the lamp of the present invention was reduced by only about 10% at the end of 1000 hours after the initiation of lighting in comparison with about a 40% reduction for the conventional lamp, which did not use the magnet.

What is claimed is:

1. An electrically energized illuminating lamp comprising a bulb and a source of light within said bulb and emitting light through a portion of said bulb, and at least one magnet around the exterior wall of the bulb at a position other than the portion of the bulb through which light is emitted for attracting metal vapor and volatile matter generated inside the bulb during operation of the lamp and depositing them onto the interior wall of the bulb at a position corresponding to that of the magnet, whereby deposits are prevented on the interior wall of the bulb in light transmission areas thereof to reduce emission of light from the lamp.

2. A lamp as claimed in claim 1 wherein said lamp is a mercury lamp.

3. A lamp as claimed in claim 2 wherein said lamp has upper and lower electrodes with said source of light therebetween, and said lamp has a pair of magnets disposed around the external wall of the bulb at positions above the upper electrode and below the lower electrode thereof, respectively.

4. A lamp as claimed in claim 1 wherein said source of light is a filament.

5. A lamp as claimed in claim 4 wherein said lamp is a halogen lamp.

6. A lamp as claimed in claim 4 wherein said lamp is an incandescent lamp.

7. A lamp as claimed in claim 4 wherein said manget is disposed around the external wall of the bulb at a position below that of the filament.

* * * * *